United States Patent [19]

Uhl

[11] 3,990,485

[45] Nov. 9, 1976

[54] BARBED WIRE CONSTRUCTION

[75] Inventor: Siegfried Uhl, Augsburg, Germany

[73] Assignee: Keller and Knappich Augsburg, Germany

[22] Filed: July 21, 1975

[21] Appl. No.: 597,349

[30] Foreign Application Priority Data

July 31, 1974 Germany ..... 2436760

[52] U.S. Cl. ..... 140/58; 29/7.1; 256/8

[51] Int. Cl.[2] ..... B21F 25/00

[58] Field of Search ..... 140/58, 66; 29/7.1, 29/7.2, 7.3, 415; 256/2, 6, 7, 8, 733; 52/735, 740; 89/36 R, 36 C

[56] References Cited

UNITED STATES PATENTS

| | | | |
|---|---|---|---|
| 212,239 | 2/1879 | Lewis | 52/735 |
| 254,904 | 3/1882 | Bate | 256/7 |
| 273,245 | 3/1883 | Bate | 256/8 |
| 310,394 | 1/1885 | Ells | 256/7 |
| 2,948,049 | 8/1960 | Wilson | 140/58 |

FOREIGN PATENTS OR APPLICATIONS

| | | | |
|---|---|---|---|
| 1,015,551 | 10/1952 | France | 52/735 |

*Primary Examiner*—Lowell A. Larson
*Attorney, Agent, or Firm*—McGlew and Tuttle

[57] ABSTRACT

A barbed wire comprises a metal strip having a longitudinally extending reinforcing rib portion and at least one plate portion extending laterally outwardly from the rib portion along its length. The plate portion has a series of triangular contiguous pointed projection portions with longitudinally extending bases and with an apex point extending outwardly from the bases offset longitudinally from the point of intersection of adjacent bases of the respective triangular projection portions. The rib portion may be reinforced by a thickened formation and a plurality of plates may extend, for example, radially outwardly from the reinforcing rib portion.

10 Claims, 7 Drawing Figures

FIG. 1
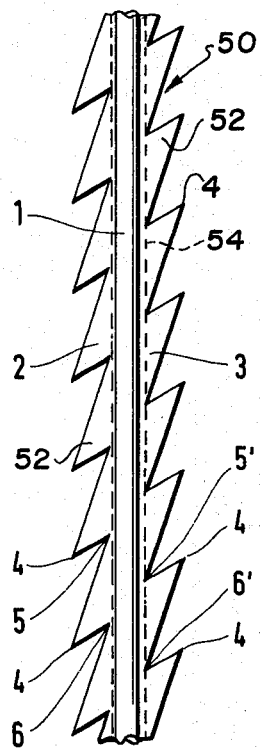
FIG. 3
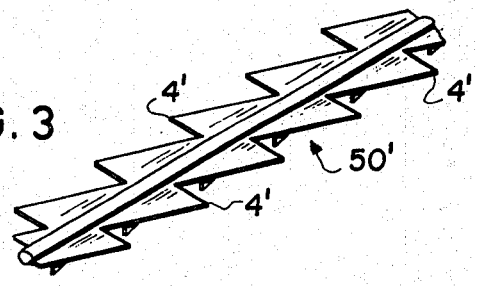
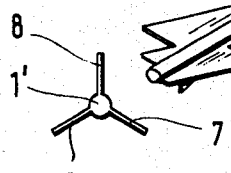
FIG. 4
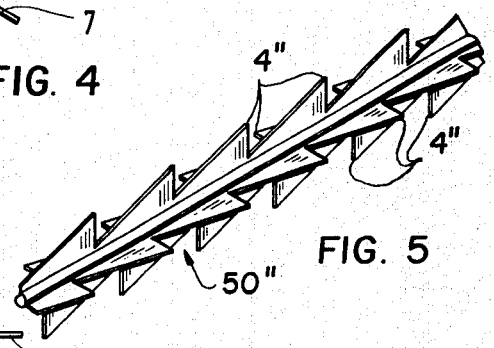
FIG. 5
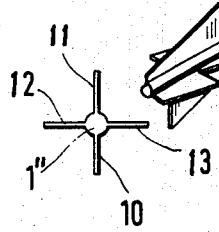
FIG. 6
FIG. 7
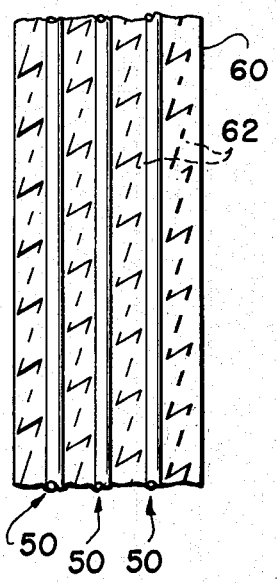
FIG. 2
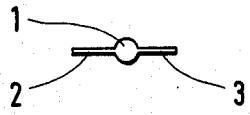

BARBED WIRE CONSTRUCTION

FIELD AND BACKGROUND OF THE INVENTION

This invention relates in general to the construction of barbed wire and, in particular, to a new and useful barbed wire which includes a metal strip having a longitudinally extending reinforcing rib portion and at least one plate portion extending outwardly from the rib portion having apex projecting points which are offset longitudinally in respect to the base portions.

DESCRIPTION OF THE PRIOR ART

The present invention relates particularly to barbed wire which is used as an obstacle and which may be stretched across an area in a simple manner to form a fence between two posts, for example. Such wire may also be used in the form of a coil which is wound in respect to its longitudinal axis to form a separate hollow cylinder of a type which is employed for military purposes, for example.

In the known designs of this kind, the points of the sharp-pointed projections are located at the center of the bases of the projections and this produces only a small obstructing effect. The bases of the projections which are formed on each side of a central reinforcing rib are provided at locations which are opposed to each other in the longitudinal direction and, consequently, material necks are formed between the consecutive projections and this considerably reduces the strength of the entire strip. In addition, metal scrap is produced by the punching operation in the formation of such wire due to the spacing of the individual pointed projections in the longitudinal direction.

Barbed wire strips are also known which have sharp points formed between cutouts provided in either of the longitudinal edges of the strip. The obstructing effect of such strips is so high that they cannot be used for civilian fences and are suitable only for military purposes. In addition, in their shape as a strip, their cross-section is strongly reduced between the individual pointed projections and so is their strength. It is also known to wind such a barbed strip by its intermediate non-pointed portions partly about a separate wire to form a helical coil. For civilian purposes, however, such a design is too expensive and too dangerous.

SUMMARY OF THE INVENTION

The present invention provides an improved barbed wire strip construction of a form which increases the obstructing effect over the prior art to an extent still acceptable for civilian purposes and also to a form which increases the strength of the strip. In accordance with the invention, the barbed wire is made up of a metal strip having sharp points formed at the apexes of triangular projections which are offset relative to the bases of such projections at their connection to the strip. Such a design results in a hook effect transverse to a reinforcing rib formation which extends longitudinally along the strip. The construction is such that upon engagement, disengagement is only possible by moving in a definite direction alongside the strip and this requires a consideration which would not be expected from an animal and only attributable to a man in a calm situation.

Aside from the provision of a reinforcing rib which may be reinforced, for example, by increasing the thickness of the metal, a further increase of the strength is obtained by providing that at the side or sides of the reinforcing rib, the connecting plates with the triangular projections have pointed projections which are offset relative to each other in a longitudinal direction. The barbed wire advantageously includes a reinforcing rib with a metal strip extending laterally therefrom along its length and one or more metal strips may extend, for example, radially offset by angles such as 180°, 120° or 90°. In the case of the 180° spacing, a barbed wire is formed with a central rib portion and a laterally extending plate portion on each side of the rib portion having the triangular projections with the offset points which extend outwardly from the plate portion. In the case of the 120° spacing, three plate strip portions are provided, and in the case of the 90° spacing, four strip plate portions are provided with one centrally located rib portion.

In the embodiment of the invention which includes a single central reinforcing rib portion and a strip portion extending outwardly from each side of the rib portion offset by 180° from each other and being in the same plane, it is advantageous to provide the pointed projections of either of the strip portions which are adjacent each other in the longitudinal direction and arranged in a continuous sequence of identical triangular formations since then a plurality of novel barbed wire strips can be produced simultaneously by cutting them out from a large metal strip blank and without producing any scrap material.

Accordingly, it is an object of the invention to provide an improved barbed wire which includes a metal strip having a longitudinally extending reinforcing rib portion on at least one plate portion extending laterally outwardly from said rib portion along its length and having substantially triangular pointed projecting portions with longitudinally extending bases and with an apex point offset longitudinally from the connecting point of the triangular projections at their bases.

A further object of the invention is to provide a barbed wire which includes a central longitudinally extending reinforcing rib and a plate portion extending laterally outwardly from each side 180° apart and with triangular contiguous projecting portions having longitudinally extending bases and with an apex point extending outwardly from the bases offset longitudinally from the point of intersection of adjacent bases of the respective triangular projection portions.

A further object of the invention is to provide a barbed wire which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

BRIEF DESCRIPTION OF THE DRAWINGS

In the drawings:

FIG. 1 is a plan view of a barbed wire constructed in accordance with the invention;

FIG. 2 is a cross-sectional view of the barbed wire shown in FIG. 1;

FIG. 3 is a perspective view of another embodiment of barbed wire;

FIG. 4 is a sectional view of the barbed wire shown in FIG. 3;

FIG. 5 is a view similar to FIG. 3 of another embodiment of the invention;

FIG. 6 is a sectional view of the barbed wire of the embodiment shown in FIG. 5; and FIG. 7 is a plan view of a metal sheet indicating how the barbed wire may be cut away therefrom without any waste.

DESCRIPTION OF THE PREFERRED EMBODIMENTS

Referring to the drawings in particular, the invention embodied therein in FIGS. 1 and 2, comprises a barbed wire, generally designated 50, which includes a longitudinally extending reinforcing rib portion 1 and a laterally extending strip portion 2 and 3 on respective sides arranged at 180° away from each other. In the embodiment indicated, the rib portion 1 is reinforced such as by a thickening of the metal material at such location.

In accordance with the invention, the strip portions 2 and 3 comprise substantially flat plates having substantially triangular projections 52 and with outwardly extending apex points 4 which are offset longitudinally in respect to bases 54 of the projections which are shown as imaginary lines which join the projections to the remainder of the plate portions 2 and 3. In a construction such as this, it is preferable if the triangular projections 52 are contiguous and the apex point 4 is offset in a longitudinal direction from a point 5 at the intersection of the bases of adjacent triangular projections 52. Triangular projections 52 may be spaced apart, in which event, the apex points 4 are offset in respect to the adjacent connecting point of the triangular projection to its base 54 at the plates 2 and 3.

In respect to the strip plate portions 2 and 3, the triangular projections 52 are advantageously offset in a longitudinal direction, as shown in the embodiment of FIG. 1. Such a construction ensures that the overall structural strength of the barbed wire 50 is enhanced since the recesses on respective sides thereof formed at the connecting points 5 or 6 of the triangular portions 52 to the remainder of the associated strip 2 or 3 are not aligned.

In the embodiment of FIGS. 3 and 4, a barbed wire 50' includes a central reinforcing rib portion 1' and with radially extending plate or strip portions 7, 8 and 9 spaced apart by 120°. The strip portions 7, 8 and 9 have triangular projections terminating in sharp pointed edges 4' as in the other embodiment.

In the embodiment shown in FIGS. 5 and 6, there are four plate portions 10, 11, 12 and 13 arranged at equally spaced locations around the circumference of a central rib portion 1'' to form the barbed wire, generally designated 50''. In this case, the plate portions are offset by 90° and each includes sharpened points 4''.

In FIG. 7, it is indicated how a plurality of barbed wire elements, generally designated 50, may be cut away from a single plate 60. In the example indicated, three separate plates 50 may be severed from the plate 60 without forming any waste between the barbed wire element 50 which are produced. The barbed wire may be formed by a combination of stamping and cutting of the plate 60 along the dotted lines 62.

While specific embodiments of the invention have been shown and described in detail to illustrate the application of the principles of the invention, it will be understood that the invention may be embodied otherwise without departing from such principles.

What is claimed is:

1. A barbed wire construction, comprising a metal strip having a substantially cylindrical longitudinally extending reinforcing rib portion and a plate portion extending outwardly from each side of said rib portion along the length of said rib portion, said plate portion having oppositely extending and oppositely directed substantially triangular pointed projection portions with end to end contiguous longitudinally extending bases, said triangular pointed projection portions having an outwardly extending apex point offset longitudinally from the point of intersection of the bases with their associated plate portions.

2. A barbed wire construction, comprising a metal strip having a longitudinally extending reinforcing rib portion and a plurality of plate portions extending outwardly from said rib portion along its length and each having substantially triangular pointed projection portions with longitudinally extending contiguous bases and with an outwardly extending apex point offset longitudinally from the point of intersection of the bases with their associated plate portions.

3. A barbed wire construction, according to claim 2, wherein said triangular projection portions are contiguous so that the bases of adjacent triangular projection portions intersect.

4. A barbed wire construction, according to claim 2, wherein there are two plate portions extending outwardly from said rib portions in radial directions 180° apart and wherein the triangular projection portions of one of said plate portions is offset longitudinally from the triangular projection portions of the other of said plate portions.

5. A barbed wire construction according to claim 4, wherein said pointed projections of said two plate portions extend in respective opposite longitudinal directions.

6. A barbed wire construction, according to claim 2, wherein said plurality of plate portions extending radially outwardly from said rib portion are arranged at selective angles around the circumference of said rib portion.

7. A barbed wire construction, according to claim 6, wherein said plate portions are offset by 180°.

8. A barbed wire construction, according to claim 6, wherein said plate portions are offset by 120°.

9. A barbed wire construction, according to claim 6, wherein said plate portions are offset by 90°.

10. A barbed wire construction, according to claim 2, wherein plate portions extend outwardly from each side of said reinforcing rib portion, each having contiguous triangular projection portions and the triangular projection portion of one of said plate portions being offset from the other, the apex points of said projection portions of each plate portion being arranged in longitudinal alignment, said triangular projection portions being of identical shape.

* * * * *